US010519797B2

(12) United States Patent
Williamson et al.

(10) Patent No.: US 10,519,797 B2
(45) Date of Patent: Dec. 31, 2019

(54) TURBINE ENGINE AND STATOR VANE PITCH ADJUSTMENT SYSTEM THEREFOR

(71) Applicant: General Electric Company, Schenectady, NY (US)

(72) Inventors: Aaron David Williamson, Taylors, SC (US); Harry McFarland Jarrett, Jr., Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 855 days.

(21) Appl. No.: 15/194,103

(22) Filed: Jun. 27, 2016

(65) Prior Publication Data

US 2017/0370243 A1 Dec. 28, 2017

(51) Int. Cl.
*F01D 17/16* (2006.01)

(52) U.S. Cl.
CPC ..... *F01D 17/162* (2013.01)

(58) Field of Classification Search
None
See application file for complete search history.

(56) References Cited

U.S. PATENT DOCUMENTS

| | | | | |
|---|---|---|---|---|
| 5,190,439 | A | 3/1993 | Das | |
| 5,692,879 | A | 12/1997 | Charbonnel | |
| 5,993,152 | A | 11/1999 | Schilling | |
| 6,174,130 | B1 | 1/2001 | King et al. | |
| 6,457,937 | B1 * | 10/2002 | Mashey | F01D 17/162 415/150 |
| 7,273,346 | B2 | 9/2007 | Bouru | |
| 7,413,401 | B2 | 8/2008 | Szucs et al. | |
| 8,435,000 | B2 | 5/2013 | Wong et al. | |
| 8,511,974 | B2 | 8/2013 | Hood et al. | |
| 8,740,547 | B2 | 6/2014 | Colotte et al. | |
| 9,890,656 | B2 * | 2/2018 | Craven | F04D 29/563 |
| 2011/0182715 | A1 * | 7/2011 | Leithead | F01D 17/162 415/148 |
| 2012/0134783 | A1 | 5/2012 | Davidson et al. | |
| 2017/0114719 | A1 * | 4/2017 | Kimura | F01D 17/162 |

OTHER PUBLICATIONS

Masood, Abeer; "They Might Be Giants: The World's Largest Gas Turbines Will Light Up Pakistan", dated Oct. 28, 2015, printed Jun. 27, 2016, 6 pages, http://www.gereports.com/might-giants-worlds-largest-gas-turbines-will-light-pakistan/.

Picture of 9HA Gas Turbine, printed Jun. 27, 2016, 1 page, http://dsg.files.app.content.prod.s3.amazonaws.com/gereports/wp-content/ uploads/2015/10/23203947/9HA_Gas_Turbine_HArriet_being_aligned_into_its_final_position-11.jpg.

* cited by examiner

*Primary Examiner* — Kayla McCaffrey
(74) *Attorney, Agent, or Firm* — Armstrong Teasdale LLP

(57) ABSTRACT

A turbine engine is provided. The turbine engine includes a plurality of first stator vanes, a plurality of second stator vanes, and a pitch adjustment system coupled to the first stator vanes and the second stator vanes. The pitch adjustment system includes a pivot shaft, a first linkage, and a second linkage. The pivot shaft has a first side and a second side opposite the first side. The first linkage is coupled to the first stator vanes on the first side of the pivot shaft. The second linkage coupled to the second stator vanes on the second side of the pivot shaft.

13 Claims, 2 Drawing Sheets

TURBINE ENGINE AND STATOR VANE PITCH ADJUSTMENT SYSTEM THEREFOR

BACKGROUND

The field of this disclosure relates generally to vane pitch adjustment systems and, more particularly, to stator vane pitch adjustment systems for use with turbine engines.

Many known turbine engines include a compressor, a combustor, and a turbine coupled in flow communication with one another. The compressor includes a plurality of compressor rotor blades, and the turbine includes a plurality of turbine rotor blades. The turbine rotor blades are rotatably coupled to the compressor rotor blades via a rotor shaft having an axis. During operation of the turbine engine, a working gas flows into the compressor and is compressed by the compressor rotor blades. The compressed gas is channeled into the combustor, and is mixed with fuel and ignited. The resulting combustion gases are then channeled into the turbine to rotate the turbine rotor blades and, thus, the compressor rotor blades via the rotor shaft.

Many known turbine engines also have a plurality of stator vanes (e.g., compressor stator vanes), and a system for adjusting the pitch of the stator vanes during operation of the turbine engine. For example, some known turbine engines have a plurality of axially-spaced apart stages of stator vanes, and some known pitch adjustment systems are designed to adjust the pitch of one stage differently than another stage. However, such systems are nonetheless limited in their ability to optimize the differential pitch adjustment to the environment in which the turbine engine is installed.

BRIEF DESCRIPTION

In one aspect, a turbine engine is provided. The turbine engine includes a plurality of first stator vanes, a plurality of second stator vanes, and a pitch adjustment system coupled to the first stator vanes and the second stator vanes. The pitch adjustment system includes a pivot shaft, a first linkage, and a second linkage. The pivot shaft has a first side and a second side opposite the first side. The first linkage is coupled to the first stator vanes on the first side of the pivot shaft. The second linkage is coupled to the second stator vanes on the second side of the pivot shaft.

In another aspect, a pitch adjustment system for a turbine engine having a plurality of first stator vanes and a plurality of second stator vanes is provided. The pitch adjustment system includes a pivot shaft having a first side and a second side opposite the first side. The pitch adjustment system also includes a first linkage coupled to the pivot shaft for coupling the first linkage to the first stator vanes on the first side of the pivot shaft. The pitch adjustment system further includes a second linkage coupled to the pivot shaft for coupling the second linkage to the second stator vanes on the second side of the pivot shaft.

In another aspect, a method for setting a pitch adjustment system of a turbine engine is provided. The method includes decoupling a foot of a linkage from a stator vane ring at a first datum feature of the stator vane ring. The method also includes recoupling the foot to the stator vane ring at a second datum feature of the stator vane ring. The second datum feature is circumferentially spaced apart from the first datum feature.

DETAILED DESCRIPTION

The following detailed description illustrates stator vane pitch adjustment systems by way of example and not by way of limitation. The description should enable one of ordinary skill in the art to make and use the systems, and the description describes several embodiments of the systems, including what is presently believed to be the best modes of making and using the systems. Exemplary stator vane pitch adjustment systems are described herein as being coupled within a turbine engine. However, it is contemplated that the stator vane pitch adjustment systems have general application to a broad range of applications in a variety of fields other than turbine engines.

Figure 1:
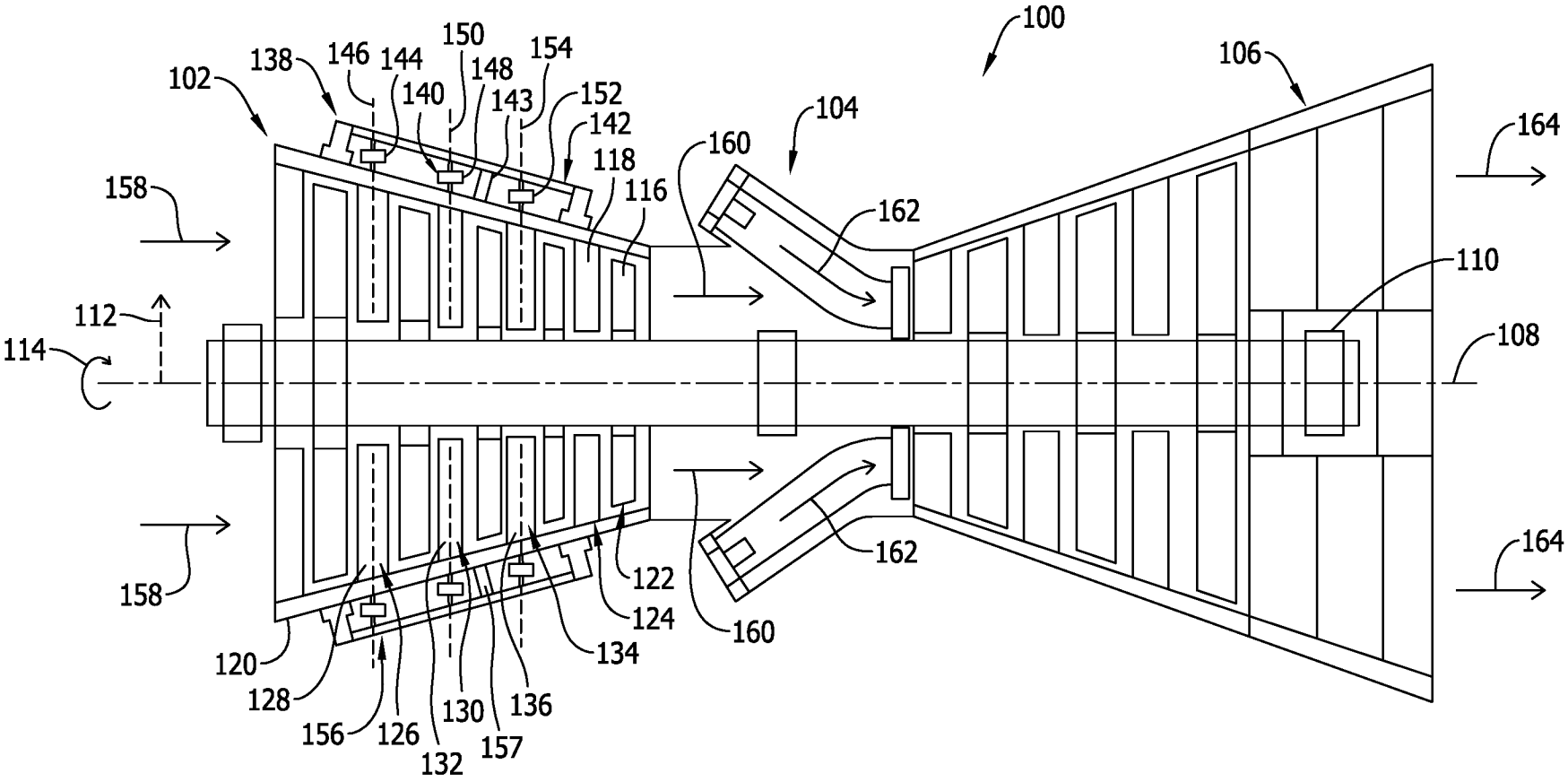
FIG. 1 is a schematic illustration of an exemplary turbine engine.

FIG. 1 illustrates an exemplary turbine engine 100. In the exemplary embodiment, turbine engine 100 is a gas turbine engine including a compressor 102, a combustor 104, and a turbine 106 coupled in flow communication with one another along a rotor axis 108 of a rotor shaft 110 such that turbine engine 100 has a radial dimension 112 that extends from rotor axis 108 and a circumferential dimension 114 that extends around rotor axis 108. As used herein, the term "radius" (or any variation thereof) refers to a dimension extending outwardly from a center of any suitable shape (e.g., a square, a rectangle, a triangle, etc.) and is not limited to a dimension extending outwardly from a center of a circular shape. Similarly, as used herein, the term "circumference" (or any variation thereof) refers to a dimension extending around a center of any suitable shape (e.g., a square, a rectangle, a triangle, etc.) and is not limited to a dimension extending around a center of a circular shape.

In the exemplary embodiment, compressor 102 includes a plurality of rotor blades 116 and a plurality of stator vanes 118 coupled within a compressor case 120. Rotor blades 116 are grouped in a plurality of axially-spaced stages 122 that circumscribe, and are rotatable together with, rotor shaft 110. Stator vanes 118 are also grouped in a plurality of axially-spaced stages 124 that circumscribe rotor shaft 110 and are axially-interspaced with stages 122. More specifically, in the exemplary embodiment, stages 124 include a first stage 126 of first stator vanes 128, a second stage 130 of second stator vanes 132, and a third stage 134 of third stator vanes 136. Although compressor 102 is illustrated as having four stages 124 of stator vanes 118 in the exemplary embodiment, compressor 102 may have any suitable number of stages 124 in other embodiments.

In the exemplary embodiment, stator vanes 128, 132, and 136 are coupled to a pitch adjustment system 138 including at least one ring 140, a linkage assembly 142, and an actuator 143 (e.g., a linear actuator) that are mounted to compressor case 120. More specifically, first stator vanes 128 of first stage 126 are coupled to a first ring 144 such that each first stator vane 128 is pivotable about a first pitch axis 146 in response actuator 143 rotating first ring 144 about rotor axis 108 via linkage assembly 142. Second stator vanes 132 of second stage 130 are coupled to a second ring 148 such that each second stator vane 132 is pivotable about a second pitch axis 150 in response to actuator 143 rotating second ring 148 about rotor axis 108 via linkage assembly 142. Third stator vanes 136 are coupled to a third ring 152 such that each third stator vane 136 is pivotable about a third pitch axis 154 in response to actuator 143 rotating third ring 152 about rotor axis 108 via linkage assembly 142.

Although each stage 126, 130, and 134 is illustrated as being coupled to its own respective ring 144, 148, and 152, pitch adjustment system 138 may have any suitable number of rings 140 coupled to any suitable number of stages 124 (e.g., more than one stage 124 may be coupled to a single ring 140 in some embodiments, and/or more than three rings 140 may be coupled to a single linkage assembly 142 in some embodiments). Moreover, pitch adjustment system 138 may have any suitable number of linkage assemblies 142 and associated actuators coupled to rings 140 in any suitable manner (e.g., in some embodiments, as illustrated, a second linkage assembly 156 and an associated second actuator 157 may be coupled to rings 144, 148, and 152 to assist linkage assembly 142 and actuator 143 when rotating rings 144, 148, and 152 about rotor axis 108 in the manner set forth herein).

During operation of turbine engine 100, a working gas flow 158 (e.g., ambient air) enters compressor 102, wherein flow 158 is compressed and channeled into combustor 104. The resulting compressed gas flow 160 is mixed with fuel and ignited in combustor 104 to generate a combustion gas flow 162 that is channeled through turbine 106, before being discharged from turbine engine 100 as an exhaust gas flow 164. Notably, when turbine engine 100 is installed in some environments (e.g., humid environments), the condition of working gas flow 158 changes periodically, and it is therefore desirable to vary the pitch of first stator vanes 128, second stator vanes 132, and/or third stator vanes 136 in accordance with such changes. For example, it may be desirable to couple rings 144, 148, and 152 to linkage assembly 142 such that, when linkage assembly 142 is actuated using actuator 143, linkage assembly 142 causes asynchronous pitch change across the stages 126, 130, and 134. More specifically, it may be desirable to simultaneously change the pitch of first stator vanes 128 a first amount, the pitch of second stator vanes 132 a second amount, and the pitch of third stator vanes 136 a third amount that are different from one another. In that regard, it may be further desirable to couple rings 144, 148, and 152 to linkage assembly 142 such that a greater degree of differential pitch change amongst stages 126, 130, and 134 can be set by an operator in the field (e.g., during installation and/or servicing of turbine engine 100) according to a schedule that is predefined (or predictable) and optimized to the environment in which turbine engine 100 is installed. This facilitates increasing the efficiency of turbine engine 100.

Figure 2:
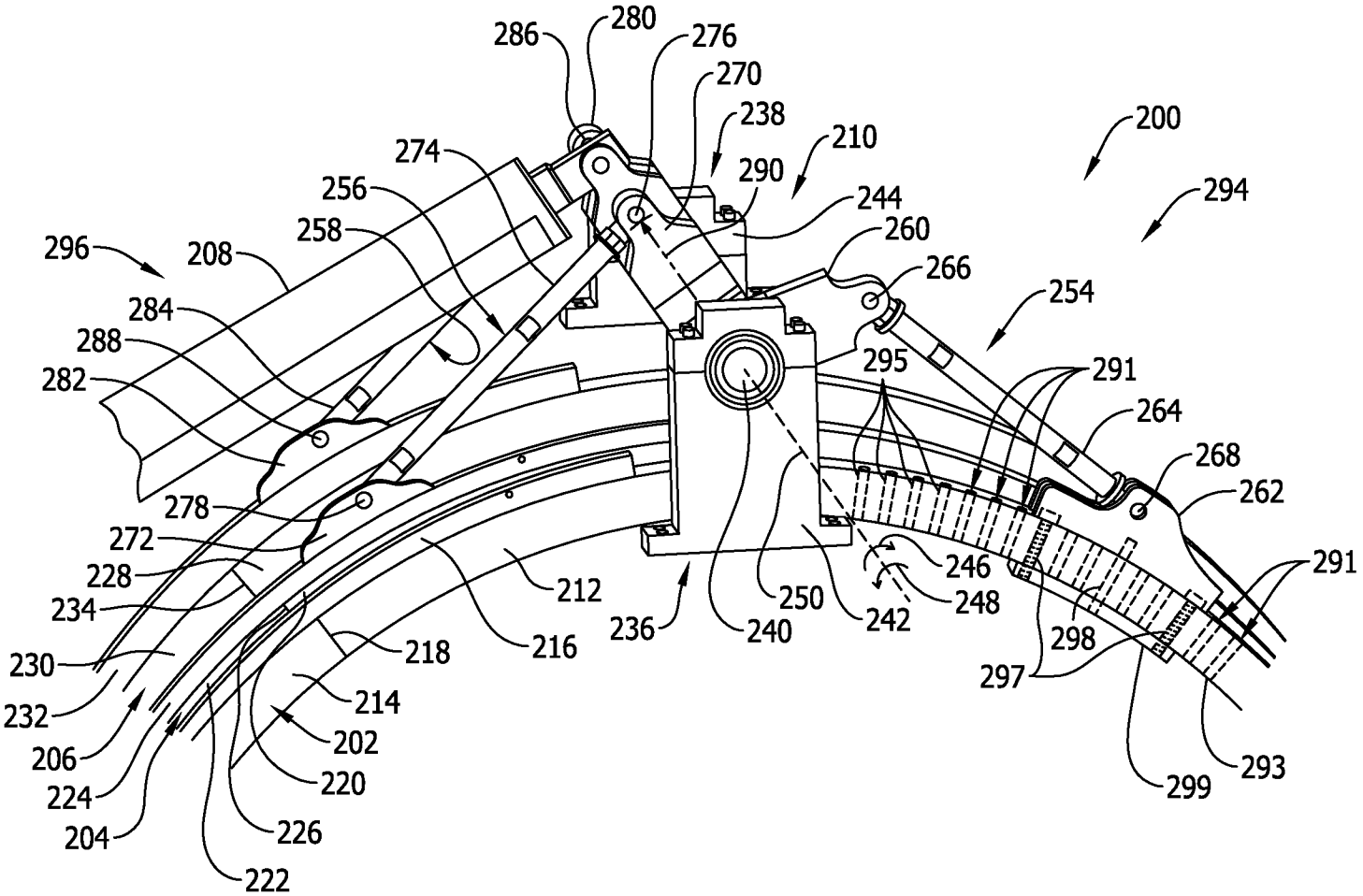
FIG. 2 is a partial perspective view of an exemplary stator vane pitch adjustment system for use in the turbine engine shown in FIG. 1.

FIG. 2 illustrates an exemplary pitch adjustment system 200 for use in turbine engine 100. In the exemplary embodiment, system 200 includes a first ring 202, a second ring 204, and a third ring 206 that are operably coupled to an actuator 208 (e.g., a linear actuator such as, for example, an electric linear actuator) via a linkage assembly 210. First ring 202 has a first segment 212, a second segment 214, and a first bridge 216 that couples first segment 212 to second segment 214 at a first joint 218. Second ring 204 has a first segment 220, a second segment 222, and a second bridge 224 that couples first segment 220 to second segment 222 at a second joint 226. Third ring 206 has a first segment 228, a second segment 230, and a third bridge 232 that couples first segment 228 to second segment 230 at a third joint 234. In other embodiments, system 200 may have any suitable number of rings each having any suitable number of segments coupled together by any suitable number of bridges.

In the exemplary embodiment, linkage assembly 210 includes a pivot mechanism 236 having a base 238 and a shaft 240 coupled to base 238. Base 238 includes a first leg 242 and a second leg 244 that support shaft 240 such that shaft 240 is rotatable in a clockwise direction 246 and in a counterclockwise direction 248 about a pivot axis 250. Shaft 240 is coupled to actuator 208 such that, by operating actuator 208, shaft 240 is rotatable about pivot axis 250. In other embodiments, shaft 240 may be rotated in any suitable manner that facilitates enabling linkage assembly 210 to function as described herein.

In the exemplary embodiment, linkage assembly 210 also includes a first linkage 254, a second linkage 256, and a third linkage 258. First linkage 254 has a first arm 260, a first foot 262, and a first rod 264 coupled to first arm 260 and first foot 262 at a first arm hinge 266 and a first foot hinge 268, respectively. Second linkage 256 has a second arm 270, a second foot 272, and a second rod 274 coupled to second arm 270 and second foot 272 at a second arm hinge 276 and a second foot hinge 278, respectively. Third linkage 258 has a third arm 280, a third foot 282, and a third rod 284 coupled to third arm 280 and third foot 282 at a third arm hinge 286 and a third foot hinge 288, respectively. In other embodiments, linkage assembly 210 may have any suitable number of linkages, and each linkage may have any suitable number of components linked together in any suitable manner that facilitates enabling the linkages to function as described herein.

In the exemplary embodiment, arms 260, 270, and 280 are coupled to shaft 240 such that arms 260, 270, and 280 extend outward from shaft 240 at orientations that are substantially perpendicular to pivot axis 250, and such that arms 260, 270, and 280 are spaced apart from one another along shaft 240. Moreover, arms 260, 270, and 280 are shaped such that their respective arm hinges 266, 276, and 286 are spaced different distances 290 from pivot axis 250 to facilitate causing rings 202, 204, and 206 to rotate comparatively different amounts in response to each rotational motion of shaft 240 clockwise or counterclockwise. In some embodiments, arms 260, 270, and 280 may have any suitable shapes such that arm hinges 266, 276, and 286 have any suitable distances 290 from pivot axis 250 (e.g., at least two of arm hinges 266, 276, and 286 may have the same distance 290 from pivot axis 250 in some embodiments). In other embodiments, each arm 260, 270, and 280 may have any suitable orientation relative to pivot axis 250 (e.g., at least one arm 260, 270, and 280 may extend from shaft 240 at an orientation that is not substantially perpendicular to pivot axis 250).

In the exemplary embodiment, first foot 262 is coupled to first ring 202 on a first side 294 of shaft 240, while second foot 272 and third foot 282 are coupled to second ring 204 and third ring 206 via second bridge 224 and third bridge 232, respectively, on a second side 296 of shaft 240 that is opposite first side 294. In that regard, first bridge 216 is likewise coupled to first ring 202 on second side 296 of shaft 240 alongside second bridge 224 and third bridge 232, such that first foot 262 is separate from (i.e., is not formed integrally with or coupled to) first bridge 216. Whereas, second foot 272 is formed integrally together with second bridge 224 such that second foot 272 and second bridge 224 are a single-piece, unitary structure, and third foot 282 is likewise formed integrally together with third bridge 232 such that third foot 282 and third bridge 232 are a single-piece, unitary structure.

In other embodiments, second foot 272 and second bridge 224, and/or third foot 282 and third bridge 232, may be formed as separate structures that are coupled together in any suitable manner (e.g., via a welded or bolted connection). For example, in some embodiments, second foot 272 and/or third foot 282 may couple to second ring 204 and/or third ring 206, respectively, in the same manner that first foot 262 couples to first ring 202, as set forth in more detail below. More specifically, in some embodiments, second foot 272 and/or third foot 282 may be separate from second bridge 224 and/or third bridge 232, respectively, such that second foot 272 and/or third foot 282 are positioned on first side 294 of shaft 240 alongside first foot 262, while second bridge 224 and/or third bridge 232 remain positioned on second side 296 of shaft 240 alongside first bridge 216.

When pitch adjustment system 200 (constructed as set forth above) is utilized in turbine engine 100, the amount of pitch change experienced by each stage 126, 130, and 134 is defined at least in part by: (A) the distance 290 of each arm hinge 266, 276, and 286 from pivot axis 250 (as set forth above); and (B) the circumferential positioning of each foot 262, 272, and 282 on its respective ring 202, 204, and 206. In that regard, first ring 202 has a plurality of circumferentially spaced-apart datum features (e.g., coupling structures such as, for example, bores 295) to which first foot 262 is selectively coupled. More specifically, first foot 262 is selectively coupled to first ring 202 via at least one fastener (e.g., a pair of bolts 297 and a dowel pin 298) sized for insertion through bores 295 and into a retainer (e.g., at least one nut and/or plate 299) seated adjacent a radially inner side 293 of first ring 202, such that first foot 262 is detachably mounted to first ring 202, thereby enabling first foot 262 to be indexed (or clocked) circumferentially along first ring 202 between a plurality of predefined locations 291.

Thus, when fabricating, installing, and/or servicing turbine engine 100, the circumferential positioning of first foot 262 on first ring 202 is selectable to enable first stator vanes 128 to experience a predefined (and predictable) amount pitch change across a greater range when shaft 240 rotates about pivot axis 250. Although the datum features (e.g., bores 295) are located on first side 294 of shaft 240 in the exemplary embodiment, the datum features may be located along any suitable segment of first ring 202 in other embodiments (e.g., first ring 202 may have datum features on first side 294 and/or second side 296 of shaft 240 in some embodiments).

By enabling at least one foot 262, 272, and 282 to be indexed (or clocked) circumferentially along its respective ring 202, 204, and 206, on at least one side 294 and 296 of shaft 240, a greater pitch change differential (or, in the graphical sense, a greater non-linearity of pitch change) can be set across the stages 126, 130, and 134. Moreover, the lengths of rods 264, 274, and 284 can be decreased, which enables a more compact design of the overall linkage assembly 210. Notably, to facilitate indexing foot 262, 272, and/or 282 in the manner set forth above, the respective rod(s) 264, 274, and/or 284 is either adjustable in length or is interchangeable with a longer/shorter replacement rod to enable the foot 262, 272, and/or 282 to be connected to its respective arm 260, 270, and/or 280 after such indexing.

The methods and systems described herein facilitate adjusting variable geometry structures such as, for example, stator vanes in a turbine engine. For example, the methods and systems facilitate asynchronously changing the pitch of a plurality of stages of stator vanes using a common actuator and/or linkage assembly. More specifically, the methods and systems facilitate increasing the amount of pitch change that can be achieved for a stage of stator vanes, while maintaining a compact size of the overall pitch adjustment system. Moreover, the methods and systems facilitate selecting an amount of pitch change of a stator vane stage from a plurality of predefined amounts of pitch change by circumferentially moving (or indexing) the connection point between a stator vane ring and its associated linkage. As a result, the methods and systems facilitate customizing the pitch adjustment system (and pitch adjustment schedule amongst stator vane stages) in accordance with an operating environment of the turbine engine, thereby enabling the turbine engine to operate more efficiency across its various operating cycles. Furthermore, the methods and systems enable such optimization to be performed in the field (e.g., during installation and/or servicing of the turbine engine), using a linkage assembly that does not increase the overall size of the turbine engine.

Exemplary embodiments of stator vane pitch adjustment systems are described above in detail. The methods and systems described herein are not limited to the specific embodiments described herein, but rather, components of the methods and systems may be utilized independently and separately from other components described herein. For example, the methods and systems described herein may have other applications not limited to practice with turbine engines, as described herein. Rather, the methods and systems described herein can be implemented and utilized in connection with various other industries.

While the invention has been described in terms of various specific embodiments, those skilled in the art will recognize that the invention can be practiced with modification within the spirit and scope of the claims.

What is claimed is:

1. A turbine engine comprising:
- a rotor shaft;
- a plurality of first stator vanes circumferentially spaced about said rotor shaft;
- a plurality of second stator vanes circumferentially spaced about said rotor shaft; and
- a pitch adjustment system coupled to said first stator vanes and said second stator vanes, said pitch adjustment system comprising
  - a first ring that circumscribes said rotor shaft and that includes a plurality of circumferentially spaced datum features, said first ring coupled between a first linkage and said first stator vanes, said first linkage comprising:
    - a foot selectively coupled to said first ring at one of said datum features for indexing said foot circumferentially along said first ring; and
    - a first segment, a second segment, and a bridge coupling said first segment to said second segment, said foot separate from said bridge;
  - a second ring that circumscribes said rotor shaft, said second ring coupled between a second linkage and said second stator vanes; and
  - a pivot shaft including a first side and a second side opposite said first side, said first linkage coupled to said first stator vanes on said first side of said pivot shaft, said second linkage coupled to said second stator vanes on said second side of said pivot shaft, said bridge is positioned on said second side of said pivot shaft and said foot is positioned on said first side of said pivot shaft.

2. A turbine engine in accordance with claim 1, wherein said pitch adjustment system comprises a linear actuator coupled to said pivot shaft.

3. A pitch adjustment system for a turbine engine having a plurality of first stator vanes and a plurality of second stator vanes, each plurality circumscribing a rotor shaft, said pitch adjustment system comprising:
- a pivot shaft having a first side and a second side opposite said first side;

a first linkage coupled to said pivot shaft for coupling said first linkage to the first stator vanes on said first side of said pivot shaft, a first stator vane ring circumscribes said rotor shaft and is coupled between said first linkage and said first stator vanes, said first linkage comprising a foot selectively coupled to said first stator vane ring at one of a plurality of datum features for indexing said foot circumferentially along said first stator vane ring, said foot extending radially outwardly from a radially outward surface of the first stator vane ring;

a bridge positioned on said second side of said pivot shaft, said foot is positioned on said first side of said pivot shaft; and a second linkage coupled to said pivot shaft for coupling said second linkage to the second stator vanes on said second side of said pivot shaft, a second stator vane ring circumscribes said rotor shaft and is coupled between said second linkage and said second stator vanes.

4. A pitch adjustment system in accordance with claim 3, wherein said first stator vane ring comprises a first segment, a second segment, and said bridge for coupling said first segment to said second segment, said foot separate from said bridge.

5. A pitch adjustment system in accordance with claim 3, wherein said first linkage comprises an arm, said foot, and a rod hingedly coupled between said arm and said foot.

6. A pitch adjustment system in accordance with claim 3, further comprising an actuator for coupling to said pivot shaft to facilitate rotating said pivot shaft.

7. A pitch adjustment system in accordance with claim 6, wherein said pivot shaft has a pivot axis and is rotatable in a clockwise direction and a counterclockwise direction about the pivot axis via said actuator.

8. A method for setting a pitch adjustment system of a turbine engine, said method comprising:

selectively coupling a foot of a linkage to a radially outer surface of a first stator vane ring at a first of a plurality of datum features for indexing said foot circumferentially along the first stator vane ring, the first stator vane ring including a first segment, a second segment, and a bridge coupling the first segment to the second segment;

decoupling the foot from said first stator vane ring at the first datum feature of said first stator vane ring; and recoupling the foot to the first stator vane ring at a second datum feature of the first stator vane ring, wherein the second datum feature is circumferentially spaced apart from the first datum feature.

9. A method in accordance with claim 8, further comprising inserting a fastener into at least one bore of the first stator vane ring to recouple the foot.

10. A method in accordance with claim 9, further comprising inserting a bolt through a first bore of the first stator vane ring to recouple the foot.

11. A method in accordance with claim 10, further comprising inserting a dowel pin into a second bore of the first stator vane ring to recouple the foot.

12. A method in accordance with claim 10, further comprising coupling the bolt to a plate seated adjacent a radially inner side of the first stator vane ring.

13. A method in accordance with claim 8, further comprising:

coupling a first bridge to said first stator vane ring on a second side of a rotor shaft alongside a second bridge and a third bridge, such that first foot is separate from said first bridge;

coupling said first foot to said first stator vane ring on a first side of the rotor shaft;

coupling a second foot to a second stator vane ring via said second bridge on a second side of the rotor shaft that is opposite said first side, second foot is formed integrally together with second bridge such that second foot and second bridge are a single-piece, unitary structure; and coupling a third foot to a third stator vane ring via said third bridge on the second side of the rotor shaft that is opposite the first side, third foot is formed integrally together with third bridge such that third foot and third bridge are a single-piece, unitary structure.

* * * * *